US011653782B1

(12) United States Patent
Hull

(10) Patent No.: US 11,653,782 B1
(45) Date of Patent: May 23, 2023

(54) TREE TOP DECORATION MOUNT

(71) Applicant: SAM HULL, LLC, Lake Oswego, OR (US)

(72) Inventor: Sam Hull, Lake Oswego, OR (US)

(73) Assignee: SAM HULL, LLC, Lake Oswego, OR (US)

( * ) Notice: Subject to any disclaimer, the term of this patent is extended or adjusted under 35 U.S.C. 154(b) by 16 days.

(21) Appl. No.: 17/079,449

(22) Filed: Oct. 24, 2020

Related U.S. Application Data

(60) Provisional application No. 63/070,536, filed on Aug. 26, 2020.

(51) Int. Cl.
*A47G 33/10* (2006.01)
*A47G 33/08* (2006.01)

(52) U.S. Cl.
CPC ..... *A47G 33/10* (2013.01); *A47G 2033/089* (2013.01)

(58) Field of Classification Search
CPC ..... A47G 33/10; A47G 2033/089
See application file for complete search history.

(56) References Cited

U.S. PATENT DOCUMENTS

| | | | | | |
|---|---|---|---|---|---|
| 3,124,856 | A * | 3/1964 | Fleminger | A47G 33/10 | 24/561 |
| 3,594,260 | A * | 7/1971 | Dieffenbach | A41G 1/007 | 140/149 |
| 5,714,211 | A * | 2/1998 | Zinbarg | A47G 33/08 | 446/268 |
| 6,037,021 | A * | 3/2000 | Koo | A47G 33/06 | 428/10 |
| 2002/0175255 | A1* | 11/2002 | Hermanson | A47G 33/10 | 248/295.11 |
| 2008/0169253 | A1* | 7/2008 | Vitale | A47B 81/00 | 211/85.7 |
| 2010/0096526 | A1* | 4/2010 | Richardson | A47G 33/10 | 248/231.81 |
| 2014/0321130 | A1* | 10/2014 | Loomis | F21V 21/32 | 362/311.13 |

* cited by examiner

*Primary Examiner* — Mark Ruthkosky
*Assistant Examiner* — Julia L Rummel
(74) *Attorney, Agent, or Firm* — Patenttm.us

(57) ABSTRACT

A mount for tree top decorations includes a central post member for positioning adjacent an upper portion of a tree trunk, and plural bendable members extending away from the central post, the members for removable engagement with branches of the tree. A receiver is provided at the top of the central post member for engaging with a decoration or other tree topper item to thereby mount the tree topper to the tree.

7 Claims, 4 Drawing Sheets

TREE TOP DECORATION MOUNT

CROSS-REFERENCE TO RELATED APPLICATIONS

This application claims the benefit of U.S. provisional application filed on Aug. 26, 2020, and having application Ser. No. 63/070,536, the entire contents of which are hereby incorporated herein by reference.

BACKGROUND

This disclosure relates to trees and more particularly to a device for mounting a tree top decoration, typically known as a tree topper, in trees and the like, such as mounting decorative top pieces in holiday tree displays.

In the field of tree displays and holiday trees, it is popular to mount decorative tree toppers to trees to provide attractive looking presentation. In the case of many Christmas trees, the top of the tree is the least substantial portion of the entire tree, and as tree toppers become more elaborate, the ability of the tree becomes inadequate to support a heavier topper or topper with larger potential wind load. Therefore, and improved way to mount decorations to tree tops is desirable.

SUMMARY

In accordance with the disclosure, an improved mount for tree topers is provided. The mount includes an elongate piece intended for positioning in a vertical orientation along the upper center of the tree trunk, with plural bendable members spaced along the piece, extending horizontally relative to the vertical piece, adapted for engaging with branches of the tree, to provide a robust mounting for a tree topper.

The subject matter of the present technology is particularly pointed out and distinctly claimed in the concluding portion of this specification. However, both the organization and method of operation, together with further advantages and embodiments thereof, may best be understood by reference to the following description taken in connection with accompanying drawings wherein like reference characters refer to like elements.

DETAILED DESCRIPTION

According to a preferred embodiment of the present disclosure a tree topper mount is provided to allow a decorative or other item to be mounted near the top of a tree, which may comprise a Christmas tree in a specific case.

Figure 1:
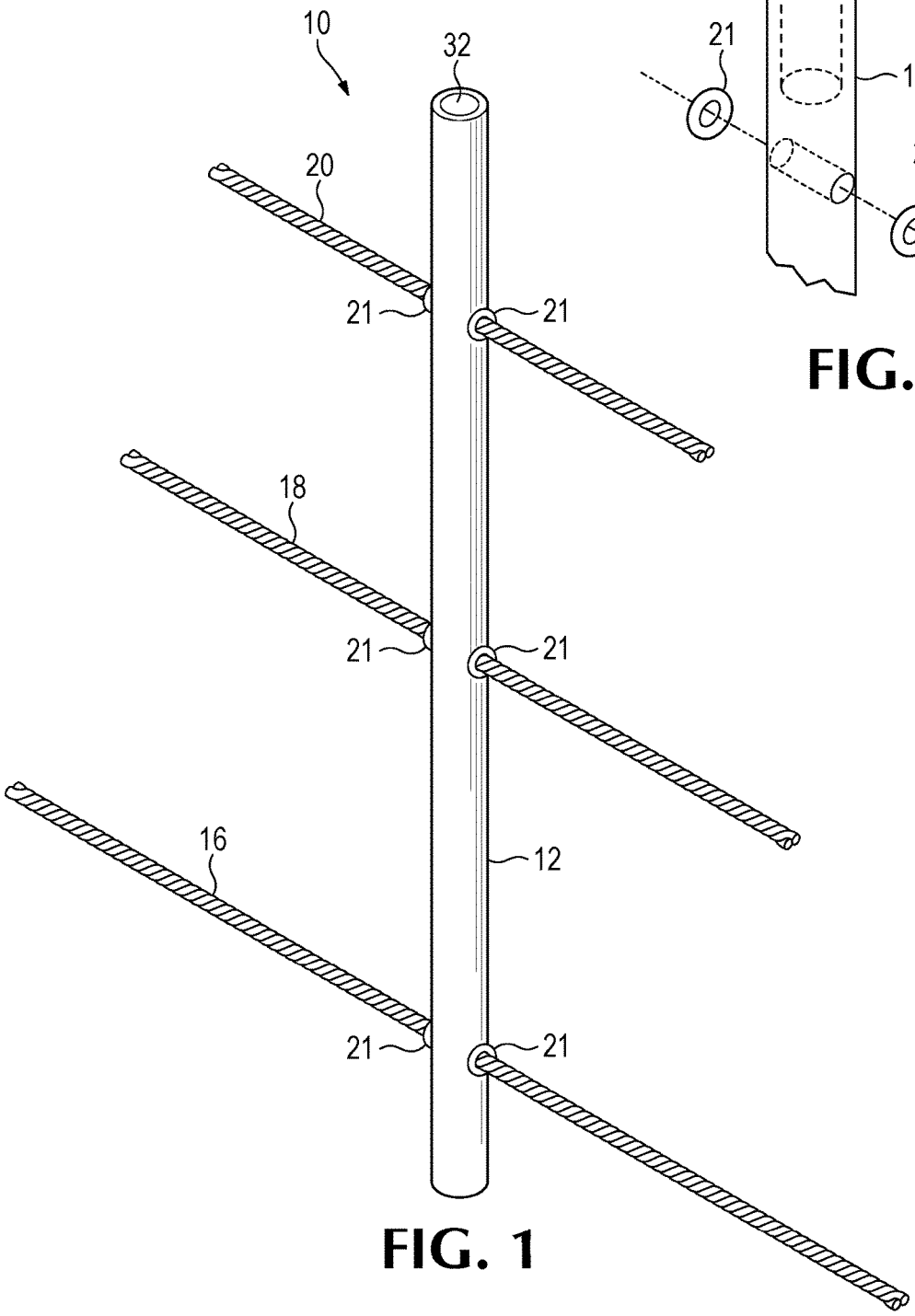
FIG. 1 is a perspective view of an exemplary tree topper mount.
Figure 2:
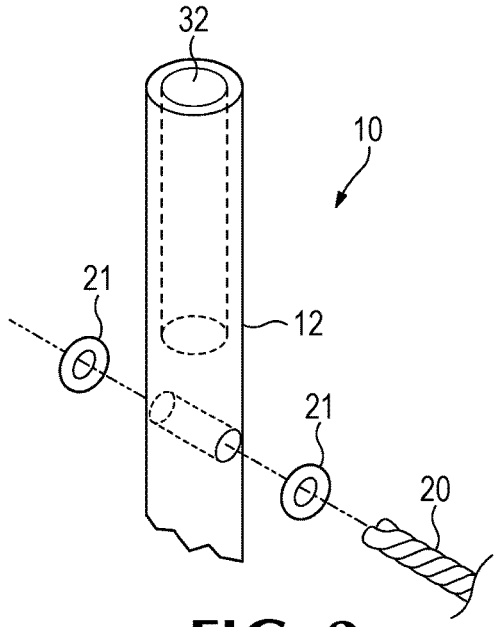
FIG. 2 is a partial close-in view of the upper portion of the tree topper mount of FIG. 1.
Figure 3:
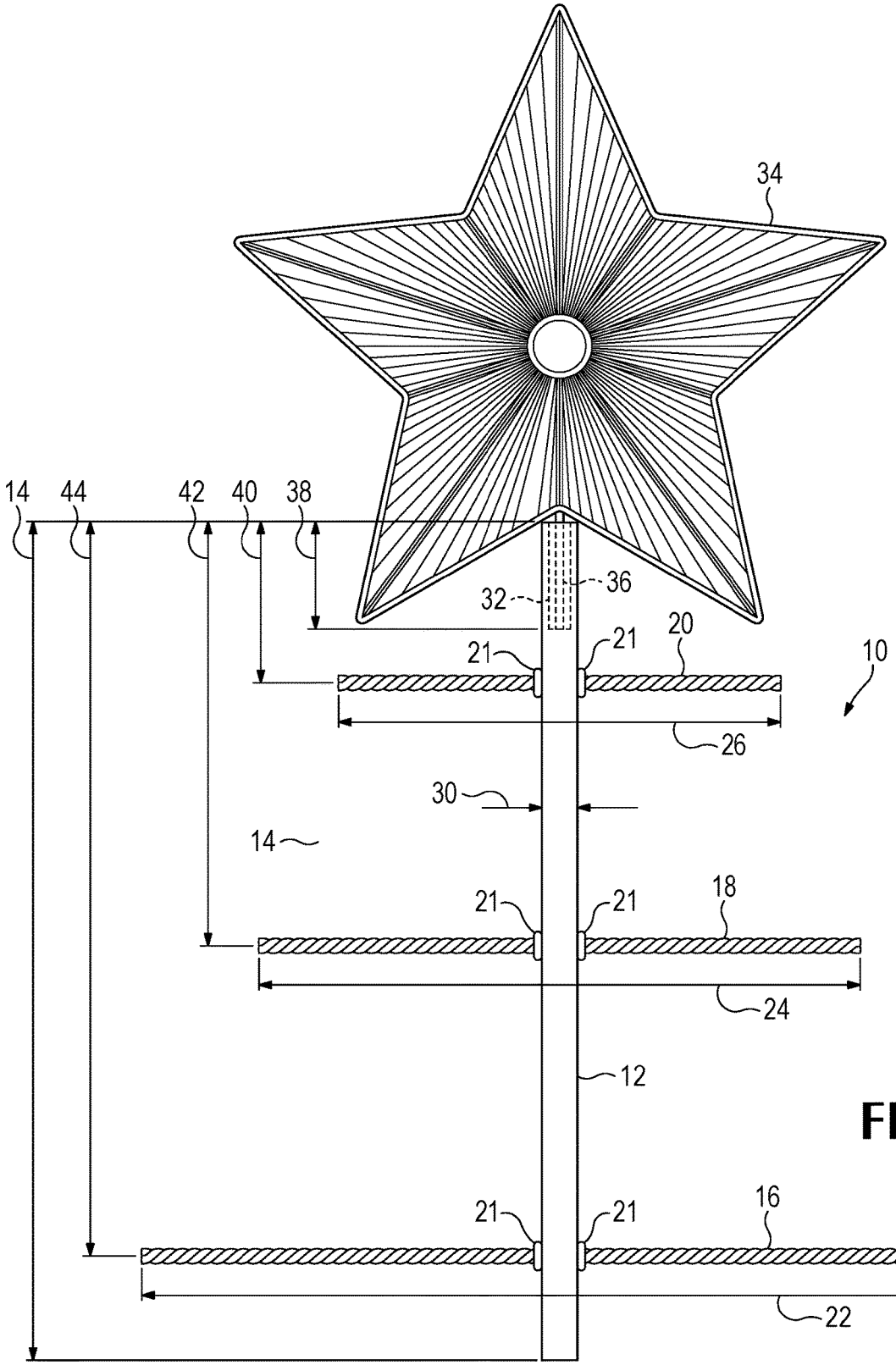
FIG. 3 is a view of the tree topper mount of FIG. 1 with a tree topper in position.

Referring to FIG. 1, a perspective view of an exemplary tree topper mount, FIG. 2, a partial close-in view of the upper portion of the tree topper mount, and FIG. 3, a view of the tree topper mount of FIG. 1 with a tree topper in position, the mount 10 comprises a central post 12 extending a length 14 in a first direction representative of a vertical axis, with plural engagement members 16, 18, 20 positioned spaced apart from one another along an extent of the central post. The engagement members extend a distance horizontally from each of 2 sides of the central post. In the preferred embodiment, member 16, the bottommost member is longest length 22, with member 18 positioned centrally of the 3 engagement members being of a middle length 24, and engagement member 20, the top most, being the shortest length 26. Positioned at the top of the central member is a receiver 32 (discussed in connection with FIG. 2) suitable for mounting a removable tree topper ornament or the like therein.

Optional mounting D-rings 21 are positioned on each side of the central post 12, placed around the engagement members to assist with maintaining the engagement members in position relative to the central post. In an alternative embodiment, such as in a case where the device is manufactured by injection molding, the D-rings may not be necessary to maintain the engagement members in position.

The central post 12 is preferably fairly rigid to hold its shape and provide a strong spine to the construct, whereas the engagement members 16, 18, 20 are flexible to allow them to be bent, but maintain their shape once bent but engage with limbs of a tree.

In use, the central post 12 of the mount is positioned along side the central trunk of a tree, near the top of the tree. The flexibility of the engagement members allows them to be bent to interact with limbs of a tree, so that the entire mount may be removably secured to an individual tree, by wrapping the engagement members around portions of limbs. Once the engagement members are secured to the tree, they hold their position and maintain the mount's position relative to the tree. Thus, once the need for the tree display is complete, the tree topper ornament may be removed and the engagement members may be disengaged from the tree limbs so that the mount can be removed, for use again at another time and/or location.

Figure 4:
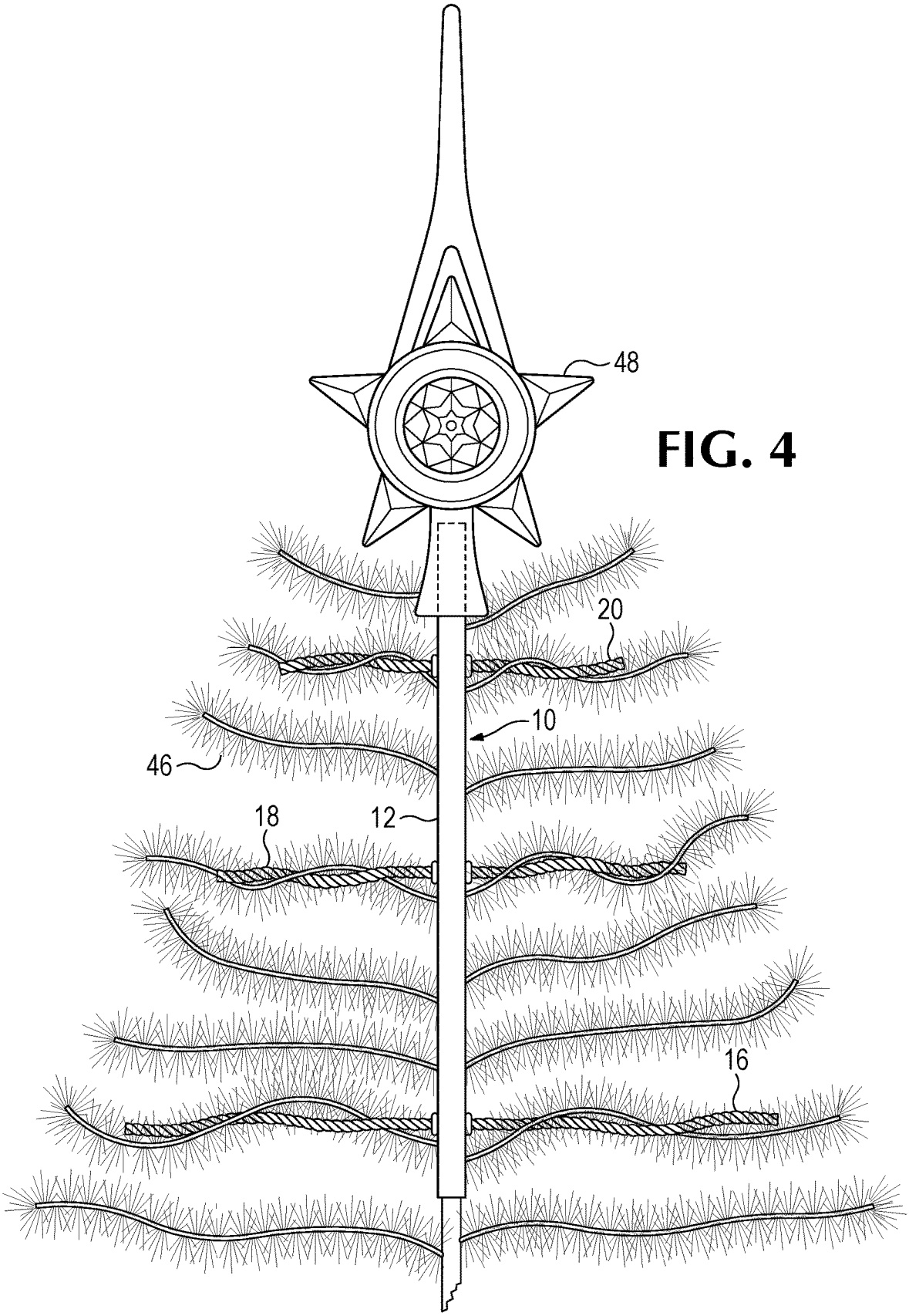
FIG. 4 is a view of a tree top decorative mount installed in a tree.

FIG. 4 illustrates a mount installed on a tree 46. It may be observed that the members 16, 18 and 20 are intertwined with branches of the tree, thereby maintaining central post 12 in position to provide a support for the mounting of tree topper 48. While the illustrated tree is an artificial tree, the device works as well with natural trees. Since the members 16, 18, 20 can be bendable, they can be wrapped around the tree branches leaving the branches in their original position, or the branches can be wrapped around the members, or a combination of wrapping both the branches and members together.

Referring to FIG. 3, showing mounting of an example tree topper therein, the illustrated topper 34 is a decorative representation of a star, and includes a mounting post 36. Once the mount 10 is secured to a tree, the post 36 is inserted into receiver 32, whereby the decoration is now positioned on the tree. The engagement of post 36 by receiver 32 can be such that the post is free to rotate within the receiver, which might be desirable in the case of topper decorations designed to spin in the wind, or the engagement can be sufficiently secure such that the topper 34 is unlikely to rotate or be inadvertently blown out of the mount by the wind.

In a particular embodiment intended for residential use, which might be used in smaller size trees, suitable dimensions comprise:

Engagement member 20 is positioned at a distance 40 being 2.25 inches from the top of central post 12.

Engagement member 18 is positioned at a distance 42 being 5.5 inches from the top of central post 12.

Engagement member 16 is positioned at a distance 44 being 9 inches from the top of central post 12.

Central post 12 length 14 is 10.5 inches/26.5 cm.

Length 22 of Bottommost member 16 is 10 inches/25 cm.

Length 24 of middle member 16 is 8 inches/20 cm.

Length 26 of topmost member 16 is 6 inches/15 cm.

Diameter 30 of central post 12 is ⅜ inch/1 cm.

Suitable D-rings 21 are 2×7 mm silicone D-rings.

Receiver 32 suitable comprises a 2 inch depth opening or hole formed in the top of the central post 12. The diameter of the hole is suitably 3.5 mm.

Openings formed in the central post 12 to receive the members 16, 18, 20 are suitable 3.5 mm diameter.

In a commercial use version, for deployment of larger tree toppers in larger trees or locations needing more robust securement, suitable dimensions comprise:

Central post 12 length 14, 18 inches/26.5 cm .

Length 22 of bottommost member 16, 10 inches/25 cm

Length 24 of middle member 16, 8 inches/20 cm

Length 26 of topmost member 16, 6 inches/15 cm

Diameter of central post 12, ½ inch/1.25 cm, with attendant adjustment of the spacing of the members 16, 18 and 20.

With reference to FIG. 6, receiver 32 suitably has a depth 38 of 2 inches (5 cm) from the top of the central post 12.

Central post 12 is tubular in particular embodiments but does not need to be and can be of any desirable cross sectional profile. Construction materials for the central post 12 can be plastic, aluminum, wood, other materials. Member 16, 18, 20 are suitably plastic or silicone coated bendable wires or the like. End caps may be provided on the members. The central post can be plastic with bendable wires extending therefrom, and the entire structure can be coated with or dipped in silicone or plastic compound that allows for movement.

Other embodiments can have the engagement members 16, 18, 20 extending from only 1 side of the central post, or one member extending one direction only from the post while another member extends in a different direction off of the post. While the illustrated embodiment has the members extending in 2 directions substantially 180 degrees from each side, more than 2 directions of extension of the engagement members and different relative angles can also be employed, the amount or members employed may depend on the weight or wind load of a particular topper that is to be attached to a tree.

The removability of the topper ornament allows changing of the type of decoration without requiring the removal of the mount from the tree if the type of display warrants such, allowing decorations to be changed with holidays or seasons as desired without requiring a new mount or reinstallation of the mount.

Figure 5:
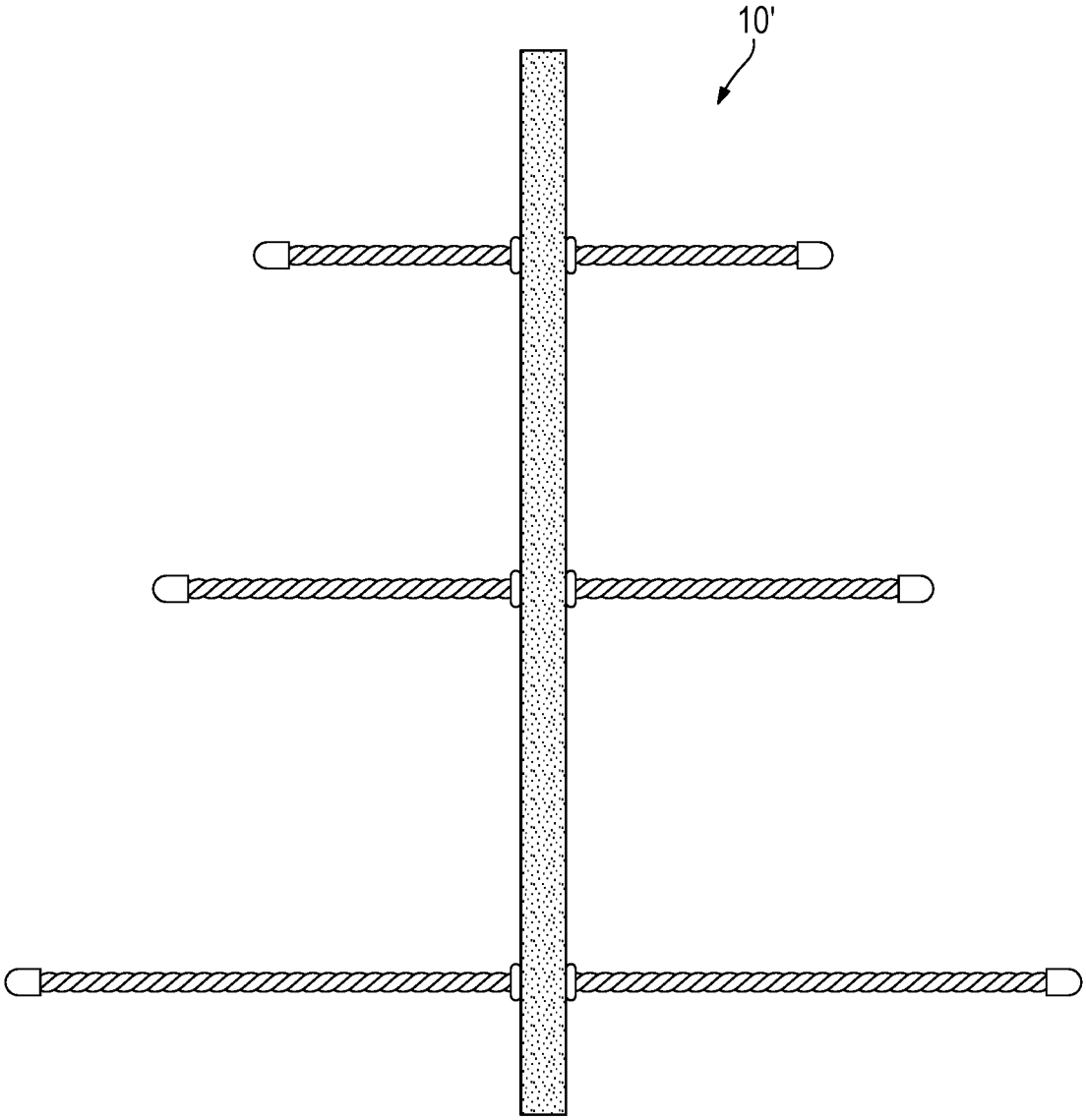
FIG. 5 is a view of a second tree topper mount of a different color.

The central post and engagement members may be provided in particular colors that match or complement the color of the trees they are being used with, so that the mount can be camouflaged by the tree and not be apparent on casual observing of the tree. Shades of green to match tree color or browns/grays to match the limb/trunk color of trees are typical colors that may be employed. FIG. 5 illustrates a different color central member from the version shown in FIGS. 1, 3 and 4, for example. End caps may be provided at the distal ends of the members 16, 18 and 20, as shown in FIG. 5.

While in the illustrated embodiment, central post 12 is substantially circular in cross section, other cross sectional shapes may be employed, such as a more flattened circle or oval, square, rectangular, triangular, or other shape.

While a preferred embodiment of the device has been shown and described, it will be apparent to those skilled in the art that many changes and modifications may be made without departing from the broader aspects. The appended claims are therefore intended to cover all such changes and modifications as fall within the true spirit and scope of the technology.

What is claimed is:

1. An assembly for mounting a tree topper, comprising:

a tree; and a device for mounting the tree topper to the tree, the tree comprising a trunk having a height axis and at least first, second and third sets of branches spaced apart from one another along the trunk of the tree along a height axis of the trunk;

the device for mounting the tree topper to the tree comprising an elongate device spine member having first and second distal ends, said elongate device spine member for positioning adjacent the trunk of the tree parallel to the height axis of the trunk; and a first elongate flexible branch engager;

a second elongate flexible branch engager;

a third elongate flexible branch engager;

said first, second and third flexible elongate branch engagers extending away from said elongate device spine member a respective first, second and third distance in first and second opposite directions from said elongate device spine member, said first, second and third elongate flexible branch engagers received by said elongate device spine member by passing through the elongate device spine member at first, second and third openings in the elongate device spine member at positions spaced apart from one another along an extent of the elongate device spine member;

the first, second and third elongate flexible branch engagers for interacting with the first, second and third sets of branches of the tree to secure the device to the tree by wrapping said first, second and third elongate flexible branch engagers around portions of the respective first, second and third sets of branches of the tree, wherein a first ring member and a second ring member are positioned around each of said first, second and third elongate flexible branch engagers at respective positions abutting opposite faces of the elongate device spine member.

2. The assembly according to claim 1, wherein said first, second and third elongate flexible branch engagers comprise a plastic or silicone outer coating.

3. An assembly for attaching a tree topper to a tree, comprising:

a tree having an elongate trunk and plural branches extending away from the elongate trunk in multiple locations along the elongate trunk; and a device comprising:

an elongate central post for positioning next to an upper portion of the elongate trunk of the tree substantially parallel to the elongate trunk of the tree, said elongate central post having plural openings formed therethrough in spaced positions along an elongate axis the elongate central post;

plural branch engagers for separately engaging separate first and second ones of said plural branches, each said plural branch engagers extending through a respective one of said plural openings of said elongate central post in at least 2 directions away from said elongate central post, said directions generally perpendicular to the elongate axis of the central post, said engagers spaced apart from one another along the elongate axis of the central post; and a tree topper receiver defined at a position on the elongate central post for removably receiving the tree topper therein for attaching the tree topper to the device, wherein said plural branch engagers are flexible to allow them to be bent, but maintain their shape once bent and engage with the first and second ones of the plural branches of the tree, a first ring member and a second ring member are positioned around each of said plural branch engagers at respective positions abutting opposite faces of the elongate central post, and each of said plural branch engagers comprises a silicone or plastic coated wire.

4. The assembly according to claim 1, wherein each said first, second and third elongate flexible branch engager comprising a silicone coated wire.

5. The assembly according to claim 1, wherein each said first, second and third elongate flexible branch engager comprising a plastic coated wire.

6. The assembly according to claim 1, wherein said elongate device spine member includes a receiver for securing the tree topper to the device.

7. The assembly according to claim 1, wherein each of said first, second and third elongate flexible branch engagers comprises a silicone- or plastic-coated wire and wherein said elongate device spine member includes a receiver for securing the tree topper to the device.

* * * * *